US006962460B1

(12) United States Patent
Pratt

(10) Patent No.: US 6,962,460 B1
(45) Date of Patent: Nov. 8, 2005

(54) APPARATUS FOR A PROTECTIVE DEVICE FOR A MAILBOX OR SIGN

(76) Inventor: Gary Pratt, 3729 Padanarum Rd., Geneva, OH (US) 44041

( * ) Notice: Subject to any disclaimer, the term of this patent is extended or adjusted under 35 U.S.C. 154(b) by 30 days.

(21) Appl. No.: 10/789,517

(22) Filed: Mar. 1, 2004

(51) Int. Cl.[7] ..... G09F 15/00
(52) U.S. Cl. ..... 404/6; 40/606.06; 248/636
(58) Field of Search ..... 40/606.1, 606.03, 40/606.06, 606.01; 404/6; 248/127, 636, 248/218.4; D99/32

(56) References Cited

U.S. PATENT DOCUMENTS 1,466,465 A * 8/1923 Belling ..... 40/607.12
1,508,052 A * 9/1924 Hastings ..... 248/145
1,893,392 A * 1/1933 Black ..... 248/145
2,605,073 A * 7/1952 Buck ..... 248/145
4,172,579 A * 10/1979 Steinman ..... 248/145
4,187,978 A 2/1980 Dowker
4,368,842 A 1/1983 DeLange
5,143,285 A 9/1992 Wise
5,206,377 A 4/1993 McAfee
5,215,283 A * 6/1993 Gould ..... 248/145
5,433,376 A * 7/1995 Kueshner ..... 232/39
5,460,326 A 10/1995 Albenesius
D365,190 S 12/1995 Albenesius
5,524,853 A * 6/1996 Varlaro ..... 248/145
6,109,519 A 8/2000 McClure
6,308,884 B1 10/2001 Hamburger
6,551,012 B1 * 4/2003 Hoebergen et al. ..... 404/6

* cited by examiner

*Primary Examiner*—Gary S. Hartmann

(57) ABSTRACT

A protective device for a mailbox or sign is discussed. The protective device has a main panel coupled to support pipes via a plurality of impact absorption mechanisms. The impact absorption mechanisms are t-bar shaped supports coupled to a back side of the main panel. The t-bar shaped support houses a spring at one end with a rod that has a stop slot and a stop screw. The protective device may also have an optional photoelectric cell light that illuminates a message, poster, sign, or any phrase.

10 Claims, 1 Drawing Sheet

APPARATUS FOR A PROTECTIVE DEVICE FOR A MAILBOX OR SIGN

BACKGROUND

1. Field

This invention relates to a protective device for signs or standard, rural or curb side mail boxes to prevent damage from the impact of snow plow debris, natural forces, and drive-by vandalism.

2. Description of Related Art

Roadside signs and mail boxes are often damaged by impact of debris, e.g. ice, snow, rocks, sand, and the like, thrown up by snow plows working close to the edge of a road. Also, drive-by vandalism of mail boxes by vandals using clubs and bats to strike the mail boxes off their posts is becoming increasingly common. Some examples of prior protectors for mailboxes and signs are as follows:

U.S. Pat. No. 4,187,978 discloses a flexible shield or cage surrounding a portion of a mail box which utilizes a hinge and shear pin arrangement.

U.S. Pat. No. 4,368,842 discloses a cage formed of spaced apart impact resistant members surrounding a mail box.

Other examples include U.S. Pat. Nos. 5,460,326, 6,109,519, 6,308,884, 5,143,285, 5,206,377, and Des 365,190.

However, the preceding patents utilize a complex mechanism or fail to sufficiently protect the entire sign or mailbox and only protect the receptacle for the sign or mailbox. Likewise, they fail to give proper notice of address and other information.

BRIEF DESCRIPTION OF THE FIGURES

The present invention is illustrated by way of example and not limitation in the Figures of the accompanying drawings.

DETAILED DESCRIPTION

Figure 1:
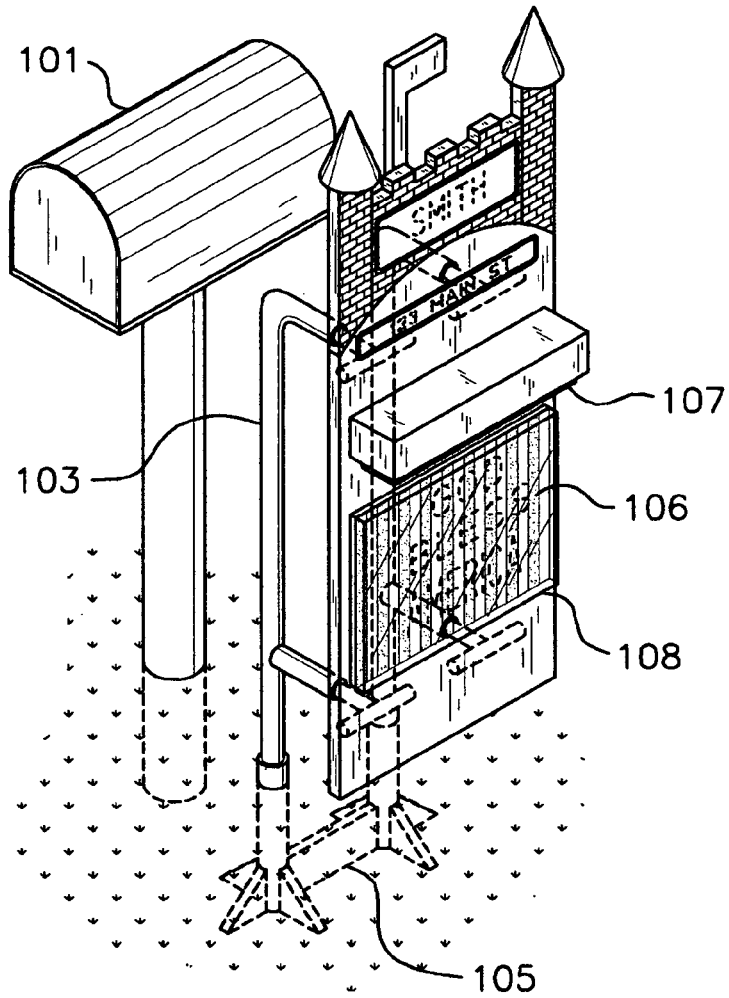
FIG. 1 illustrates an apparatus utilized in accordance with an embodiment
Figure 2:
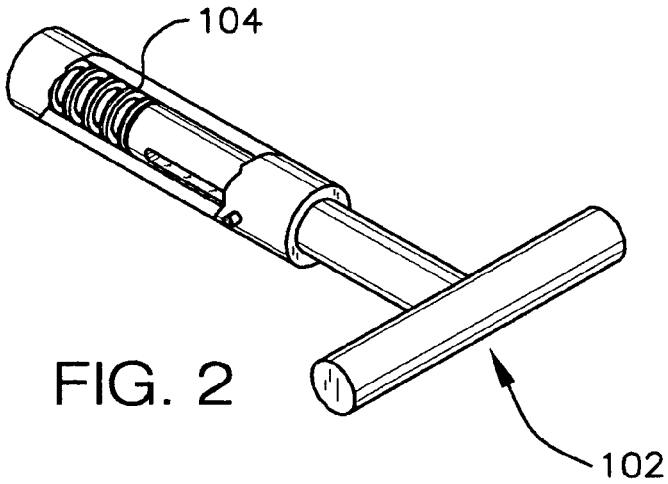
FIG. 2 depicts an impact absorption mechanism as utilized by one embodiment.

The following description provides an apparatus for a protective device for a mailbox or sign. In the following description, numerous specific details are set forth in order to provide a more thorough understanding of the present invention. It will be appreciated, however, by one skilled in the art that the invention may be practiced without such specific details. Those of ordinary skill in the art, with the included descriptions, will be able to implement appropriate logic circuits without undue experimentation.

As previously described, various problem exist for protective devices for signs or mailboxes. For example, they fail to sufficiently protect the entire sign or mailbox and only protect the receptacle for the sign or mailbox. Likewise, they fail to give proper notice of address and other information. In contrast, in one aspect, the claimed subject matter depicts a protective device that is sturdy and easy to assemble and offers various options. The claimed subject matter depicts a panel coupled to support pipes 103 via a plurality of impact absorption mechanisms 102. Also, the protective device offers various options. For example, in one embodiment, the protective device utilizes a top panel to display a customized message, poster or sign 106, and may include an address and name plate. Likewise, in another embodiment, a photoelectric cell light 107 may be coupled to the protective device to offer illumination for a message, poster, sign, or any phrase. Also, in another embodiment, the protective device may be mounted to anchor pipes in the ground via a leveling/alignment anchor apparatus 105. The anchor apparatus may be sealed with a plurality of rubber plugs. In yet another embodiment, the message, poster, sign, or poster is enclosed within a water-tight compartment 108.

FIG. 1 illustrates an apparatus utilized in accordance with an embodiment. The apparatus depicts a protective device for a mailbox or sign. The protective device comprises a main panel coupled to support pipes via a plurality of impact absorption mechanisms. In one embodiment, the impact absorption mechanisms are depicted by label 102 and comprise a t-bar shaped support coupled to a back side of the main panel. The t-bar shaped support houses a spring 104 at one end with a rod that has a stop slot and a stop screw. In this embodiment, the length of the support mechanism is six inches. Upon impact, the t-bar shaped supports absorb the force by allowing the t-bar to be pushed back to push back on the spring. Upon completion of the impact, the spring releases back to the original position. In one embodiment, four t-bar shaped supports are coupled to the back side of the protective device.

In one embodiment, the protective device is 60 inches in height, 20 inches in width and length, and is 3/16 inches in thickness. The protective device may be manufactured with wood, metal, plastic or any combination of these materials. In one embodiment, the support pipes may comprise a 1¼ inches base pipe with a 1 inch support pipe. In alternative embodiments, the main and top panel may be flat shaped or arched.

Also, in another embodiment, the protective device may be mounted to anchor pipes in the ground via a leveling/alignment anchor apparatus. The anchor apparatus may be sealed with a plurality of rubber plugs.

As previously discussed, a main panel may be used to protect the mailbox or sign and may include a message or sign. In an optional embodiment, a top panel may be coupled to the main panel via interlocking tabs to display a customized message, poster or sign, and may include an address and name plate. Likewise, in another embodiment, a photoelectric cell light may be coupled to the protective device to offer illumination for a message, poster, sign, or any phrase. In yet another embodiment, the top panel may include an outgoing mail flag lever 108.

The apparatus may be placed in front of a mailbox or sign to protect it from the impact of snow plow debris, natural forces, and drive-by vandalism. For example, it may be placed in between the mailbox or sign and the adjacent road or driveway. Alternatively, it may be placed in the direction of an expected wind or natural force. However, the claimed subject matter is not limited to the previously described locations. For example, multiple sign protectors, such as four, may be employed to form a rectangular shield around the mailbox or sign.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure.

What is claimed is:

1. An apparatus for a protective device to a sign or mailbox comprising:

a main panel, coupled to a plurality of support pipes via a plurality of impact absorption supports; and the plurality of impact absorption supports with a t-bar configuration, the t-bar to be coupled to the main panel, and to release against a spring via rod with a stop slot and a stop screw.

2. The apparatus of claim 1 further comprising a top panel, coupled to the main panel.

3. The apparatus of claim 1 wherein the main panel is a flat shape.

4. The apparatus of claim 1 wherein the main panel is an arched shape.

5. An apparatus for a protective device to a sign or mailbox comprising:

a main panel, coupled to a plurality of support pipes via a plurality of impact absorption supports;

a top panel, coupled to the main panel, and the plurality of impact absorption supports with a t-bar configuration, the t-bar to be coupled to the main panel and the top panel, and to release against a spring via rod with a stop slot and a stop screw.

6. The apparatus of claim 5 wherein the main panel and top panel are flat shaped.

7. The apparatus of claim 5 wherein the main panel are arched shaped.

8. An apparatus for a protective device to a sign or mailbox comprising:

a main panel, coupled to a plurality of support pipes via a plurality of impact absorption supports;

a top panel, coupled to the main panel;

the plurality of impact absorption supports with a t-bar configuration, the t-bar to be coupled to the main panel and the top panel, and to release against a spring via rod with a stop slot and a stop screw; and a photoelectric cell light, coupled to either the top or main panel, to illuminate a predetermined sign or message.

9. The apparatus of claim 8 wherein the main panel and top panel are flat shaped.

10. The apparatus of claim 8 wherein the main panel are arched shaped.

* * * * *